United States Patent [19]

Murphy

[11] Patent Number: 4,607,462

[45] Date of Patent: Aug. 26, 1986

[54] COOLING AND LUBRICATING DEVICE FOR SHARPENING FEED CHOPPING KNIVES

[76] Inventor: Charles J. Murphy, Rte. #4, Abilene, Kans. 67410

[21] Appl. No.: 688,531

[22] Filed: Jan. 3, 1985

[51] Int. Cl.[4] ..... B24B 55/02; B24D 5/10

[52] U.S. Cl. ..... 51/213; 51/266; 51/267

[58] Field of Search ..... 51/213, 250, 266, 267, 51/322; 184/65

[56] References Cited

U.S. PATENT DOCUMENTS

| | | | |
|---|---|---|---|
| 813,348 | 2/1906 | Burton | 51/267 |
| 817,013 | 4/1906 | Spence et al. | 51/267 X |
| 2,380,332 | 7/1945 | Scheer | 51/267 |
| 2,465,523 | 6/1945 | Franke | 184/65 |
| 4,246,729 | 1/1981 | Murphy | 51/250 |

*Primary Examiner*—Frederick R. Schmidt
*Assistant Examiner*—Bradley I. Vaught
*Attorney, Agent, or Firm*—Edwin H. Crabtree

[57] ABSTRACT

A cooling and lubricating device for sharpening feed chopping knives. The device sharpening the knives mounted on a rotating cutter head disposed inside a chopper box. The knives used for cutting crops, forage, ensilage and the like. The device is lowered on top of feed chopping knives so that the knives are continuously sharpened during the cutting operation. Further the device may be pivoted above the chopping box when the knives have been sharpened to prevent the sharpening stone from being exposed to potential breakage from foreign material received inside the chopping box.

2 Claims, 6 Drawing Figures

COOLING AND LUBRICATING DEVICE FOR SHARPENING FEED CHOPPING KNIVES

BACKGROUND OF THE INVENTION

This invention relates to a device for sharpening feed chopping knives and more particularly, but not by way of limitation, to a cooling and lubricating device for providing a coolant and lubricant to a sharpening stone as the sharpening stone is used for sharpening the rotating feed chopping knives.

This invention relates to an improved cooling and lubricating device used for sharpening feed chopping knives and is a substantial improvement over U.S. Pat. Nos. 4,031,670 and 4,246,729 issued to the subject inventor.

Heretofore, in the self-sharpening of feed chopping knives there has been no provision for introducing a coolant or lubricant onto the face of a sharpening stone to aid in the sharpening of the edges of the feed chopping knives.

The subject invention is unique in design and provides the following advantages as described herein.

SUMMARY OF THE INVENTION

The subject cooling and lubricating device for self-sharpening feed knives provides a sharpener housing mounted on a chopper box with a fluid reservoir for feeding a coolant and lubricant to a permeable sharpening stone to aid in cooling and sharpening of the feed chopping knives.

The invention cools and lubricates the cutting face of the sharpening stone and the edges of the knives thereby greatly increasing the life of the sharpening stone and improving the overall efficienty of sharpening the feed chopping knives.

The cooling and lubricating device is simple in design and is readily adaptable for mounting on various types and styles of chopping boxes. Further the cooling and lubricating system is adaptable for using various types of coolants such as water, cutting oil and water soluable lubricants which are readily adaptable for use with a permeable sharpening stone.

The cooling and lubricating device for sharpening feed chopping knives includes a sharpener housing mounted on the chopper box and disposed above the opening in the box. A fluid reservoir is mounted in the housing for holding fluid therein. The reservoir has an opening in the bottom thereof. An elongated sharpening stone is attached to the bottom of the reservoir. The stone is porous for receiving fluid from the opening of the reservoir when the bottom of the stone is disposed adjacent the rotating chopping knives. The fluid permeates through the stone for cooling and lubricating the knives and the stone.

The advantages and objects of the invention will become evident from the following detailed description of the drawings when read in connection with the accompanying drawings which illustrate preferred embodiments of the invention.

DETAILED DESCRIPTION OF THE DRAWINGS

Figure 1:
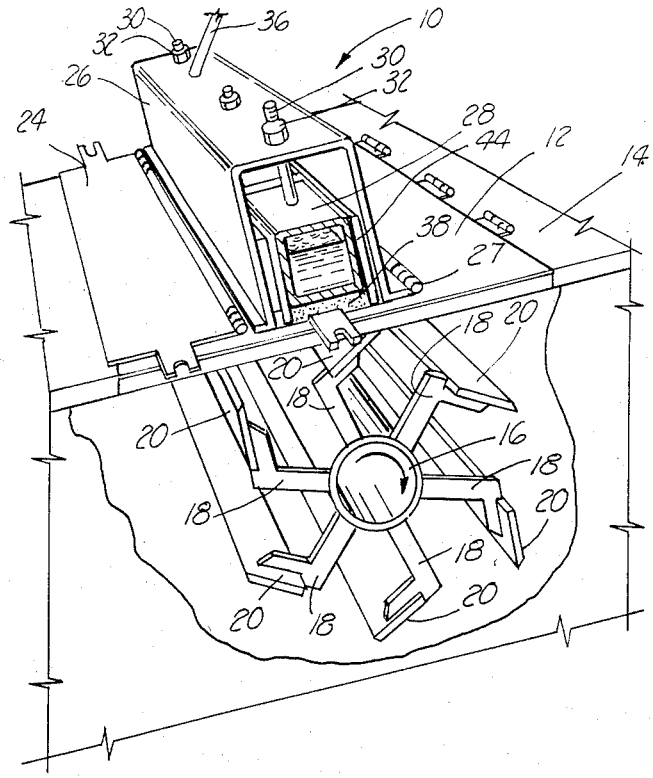
FIG. 1 is a perspective view of the cooling and lubricating device disposed above a rotating cutter head with feed chopping knives.

In FIG. 1 the cooling and lubricating device for sharpening feed chopping knives is designated by general reference numeral 10. The device 10 is shown mounted on top of a mounting plate 12 which is hinged to the top of a feed chopper box 14. The chopper box 14 is cut-away in FIG. 1 to expose a rotating cutter head 16 having arms 18 for mounting a plurality of feed chopping knives 20 thereon.

The device 10 is shown in a lowered position above an opening 22 in the top of the chopper box 14. When the device 10 is rotated 90° in a raised position and shown in dotted lines in FIG. 2, a hinged cover plate 24 can be rotated on the mounting plate 12 above the opening 22 to enclose the chopper box 14 when the device 10 is not in use.

The device 10 includes a sharpener housing 26 hinged with hinges 27 on top of the mounting plate 12. If the mounting plate 12 is not used, the housing 26 can be hinged directly on top of the chopper box 14 with the bottom of the housing 26 disposed above the opening 22. An enclosed fluid reservoir 28 is adjustably mounted inside the housing 26 through the use of threaded bolts 30 and nuts 32. The end of the reservoir 28 has been cut away to expose a fluid 34 therein. The fluid 34 may be water, water soluable oil, cutting oil or any similar type of coolant or lubricate. A fluid fill line 36 is connected to the top of the reservoir 28 for supplying the fluid 34 thereto.

Figure 2:
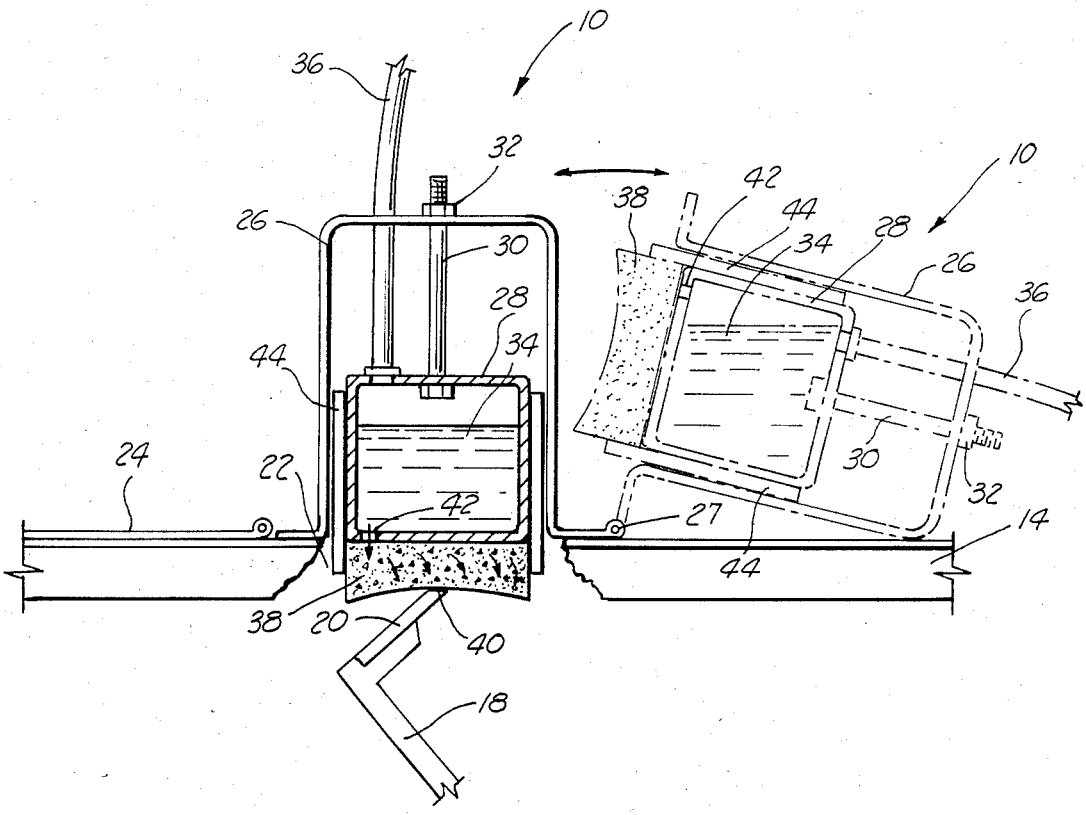
FIG. 2 is a side view of the device in a lowered position and shown in dotted lines in a raised position.
Figure 6:
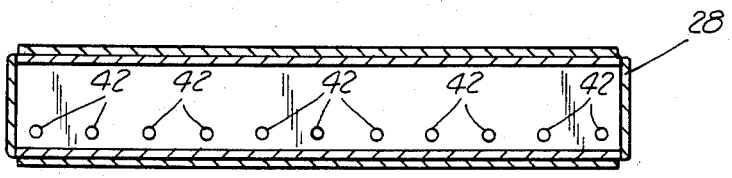
FIG. 6 is a bottom view of the device taken along lines 6—6 shown in FIG. 5.

Referring now to FIG. 2, a portion of the top of the chopper box 14 has been cut-away to expose a side view of an elongated sharpening stone 38 which when the device 10 is in a lowered position engages a cutting face 40 of the feed chopping knife 20. The elongated cutting stone 38 is porous so that the fluid 34 when received through a plurality of openings 42 as shown in FIG. 6 allows the fluid to permeate through the entire length of the stone 38 and onto the face 40 of the feed chopping knife 20. The top of the stone 38 is secured to the bottom of the fluid reservoir 28 by a pair of stoneholders 44 disposed on opposite sides of the reservoir 28.

To protect the sharpening stone 38 after the knives 20 have been sharpened the entire cooling and lubricating device 10 is pivoted on the hinges 27 which allows the device 10 to rotate 90° into a raised position as shown in dotted lines in FIG. 2. It should be noted that the openings 42 are disposed on one side of the bottom of the reservoir 28 and on the opposite side of the hinges 27. Therefore, when the device 10 is rotated 90° in a raised position, the openings 42 are disposed above the fluid level 34 to prevent the fluid 34 from continuing to be discharged out the openings 42 and into the top of the porous sharpening stone 38.

Figure 3:
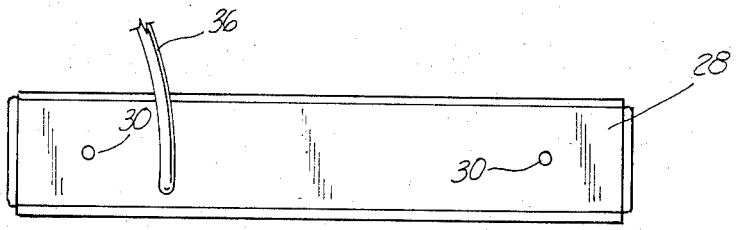
FIG. 3 is a top view of the cooling and lubricating device.

In FIG. 3 a top view of the reservoir 28 is shown with the fluid fill line 36 and bolts 30 extending upwardly therefrom.

Figure 4:
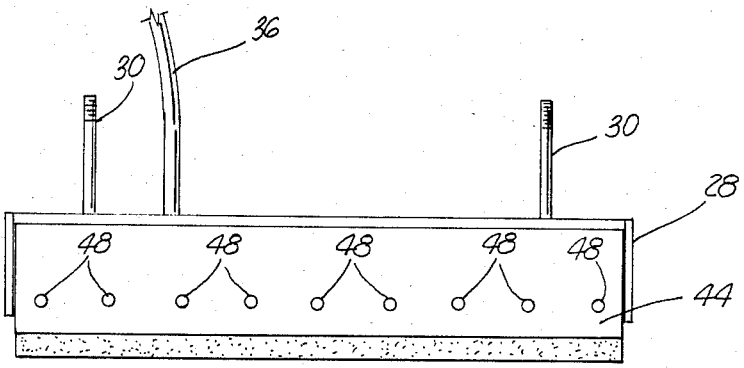
FIG. 4 is a side view of the cooling and lubricating device.

FIG. 4 a side view of the reservoir 28 is shown removed from the sharpener housing 26. In this view one of the stoneholders 44 can be seen attached to the side of the reservoir 28 by a plurality of fasteners 48.

Figure 5:
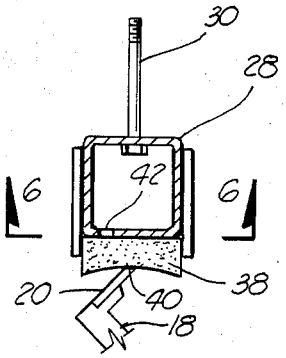
FIG. 5 is a side sectional view of the fluid reservoir and elongated sharpening stone.

In FIG. 5 a side sectional view of the reservoir 28 is shown with the stoneholders 44 securing the sharpening stone 38 to the bottom thereof. Also shown in this view is bolt 30 which is used for adjusting the depth of the reservoir 28 and sharpening stone 38 inside the sharpening housing 26.

It should be noted by adjusting the nuts 32 on the threaded bolts 30 as shown in FIG. 1 the bottom of the elongated sharpening stone 38 is adjusted in the opening 22 for proper engagement of the cutting edge 40 of the knives 20. As the bottom face of the sharpening stone 38 becomes warn, the reservoir 28 and sharpening stone 30 would be adjusted downwardly for the continuous engagement of the knives 20.

In FIG. 6 a bottom view of the reservoir 28 is shown taken along lines b—6 shown in FIG. 5. In this view the plurality of openings 42 can be seen along one side of the bottom of the reservoir 28. In this view the sharpening stone 38 has been removed to illustrate the openings 42.

From reviewing the above drawings, it can be seen that the cooling and lubricating device 10 can be mounted on various types of feed chopper boxes having rotating cutter heads with feed chopping knives. The device 10 provides a cooling and lubricating fluid through a porous sharpening stone 38 to the cutting edge 40 of the feed chopping knives 20 so as the knives 20 are sharpened, continuous coolant and lubricant are provided for extending the wear life of the sharpening stone 38 and improving the overall efficiency of sharpening feed chopping knives during a feed chopping operation.

Changes may be made in the construction and arrangement of the parts or elements of the embodiments as described herein without departing from the spirit or scope of the invention defined in the following claims.

What is claimed is:

1. A cooling and lubricating device for sharpening feed chopping knives, the knives mounted on a rotating cutter head disposed inside a chopper box, the device comprising:

a sharpener housing hinged on the top of the chopper box and disposed above an opening in the box;

an elongated fluid reservoir mounted in the housing for holding fluids therein, the reservoir having a plurality of openings along one side of the reservoir bottom, the openings in the bottom of the reservoir are above the fluid level when the hinged housing and reservoir are rotated 90 degrees in a raised position;

an elongated sharpening stone attached to the bottom of the reservoir by stone holders disposed on opposite sides of the reservoir, the stone porous for receiving fluid from the openings along the length thereof, the bottom of the stone disposed adjacent the rotating knives, the fluid permeating through the stone for cooling and lubricating the knives and the stone as the stone sharpens the knives;

means for raising and lowering the fluid reservoir and sharpening stone in the housing; and a fluid fill line attached to the top of the reservoir for supplying fluid thereto.

2. The device as described in claim 1 wherein the means for raising and lowering the fluid reservoir and sharpening stone is threaded bolts attached to the top of the reservoir and the top of hinged housing.

* * * * *